United States Patent [19]

Felser

[11] Patent Number: 4,592,182

[45] Date of Patent: Jun. 3, 1986

[54] CORNERING SYSTEM FOR BUILDINGS

[75] Inventor: Theodore P. Felser, Winter, Wis.

[73] Assignee: Felser Forest Products, Inc., Winter, Wis.

[21] Appl. No.: 606,544

[22] Filed: May 3, 1984

Related U.S. Application Data

[63] Continuation of Ser. No. 243,363, Mar. 13, 1981.

[51] Int. Cl.[4] ..... E04B 1/10

[52] U.S. Cl. ..... 52/233

[58] Field of Search ..... 52/313, 747

[56] References Cited

U.S. PATENT DOCUMENTS

| | | | |
|---|---|---|---|
| 1,654,120 | 12/1927 | Ewing | 52/233 |
| 2,309,426 | 1/1943 | Williams | 52/233 |
| 4,320,610 | 3/1982 | Rupp | 52/233 |

*Primary Examiner*—Carl D. Friedman

*Attorney, Agent, or Firm*—Nicholas A. Kees

[57] ABSTRACT

An improved cornering system for use on any building employing siding as its outer protective surface. The siding used here has a rounded outer surface and can be either of the ship lap or the tongue-in-groove type. One portion of siding is cut off such that, when affixed to the corner studs, it extends beyond the corner studs. The portion of siding to be applied to the intersecting wall is cut so that it reaches short of the extended portion of siding. A log block is then inserted in the gap left between the above two siding portions, and secured to both the corner studs and the extended siding portion. To make assembly cleaner and to give a more finished look, the notch or groove at the bottom of the extended portion is filled in with the same material as the siding, and the ridge or tongue at the upper edge is removed.

2 Claims, 7 Drawing Figures

CORNERING SYSTEM FOR BUILDINGS

This is a continuation of application Ser. No. 243,363, filed Mar. 13, 1981.

BACKGROUND OF THE INVENTION

This invention relates to buildings which are to have a "log-cabin" appearance, and more particularly to those buildings which have log ends protruding on the corners to give a more realistic log appearance.

Previously, most "log home" type buildings were built in one of two ways. In one method whole round logs were stacked, one on top of another, to form the walls of the building, with the ends of the logs protruding alternately, in standard pioneer fashion. In the other commonly used method, siding with a rounded outside face was applied to a standard wood frame house to give a log appearance, although at the corners the siding was simply cut at a 45° angle, giving the house square corners.

The disadvantage of the first method is that a great deal of sealing material must be placed between the logs in order to seal out the weather. Even if this is done, however insulation is still a problem, as wood is a poor insulator againt the cold, compared to modern commercial insulation, such as fiberglass. The disadvantage of the second method is that, with the squaring of the corners, the classic alternating protruding log appearance is lost completely. The building then looks much like any other frame building having wood siding.

The structure described in Williams, U.S. Pat. No. 2,309,426, issued Jan. 26, 1943, attempts to solve certain of these problems. That patent describes a structure wherein the rounded siding is attached to the studs by means of angle irons. The ends of the siding boards are alternately extended beyond the corners. The disadvantage here again is that the appearance is merely that of a board protruding beyond the corner, not an actual log in the classic pioneer style.

SUMMARY OF THE INVENTION

The invention includes the conventional cornering studs of a frame building, siding having a rounded outer surface, said siding being either of the tongue-in-groove or preferably the ship lap design, with a log block applied at the corner so as to give a full log appearance to the building.

A primary object of the invention is to provide an improved log cornering system for a building.

Another object of the invention is to provide an improved log cornering system which closely resembles actual full log buildings in appearance.

A more specific object of the invention is to provide an improved log cornering system which employs rounded siding and conventional wall studs, so that the building can be better insulated against the cold.

Another specific object of the invention is to provide an improved log cornering system wherein the rounded siding protrudes beyond the corner stud of the building, and a piece is added to round out the log appearance of the corner.

Other objects and advantages of the invention will appear hereinafter.

DESCRIPTION OF THE PREFERRED EMBODIMENTS

Figure 1:
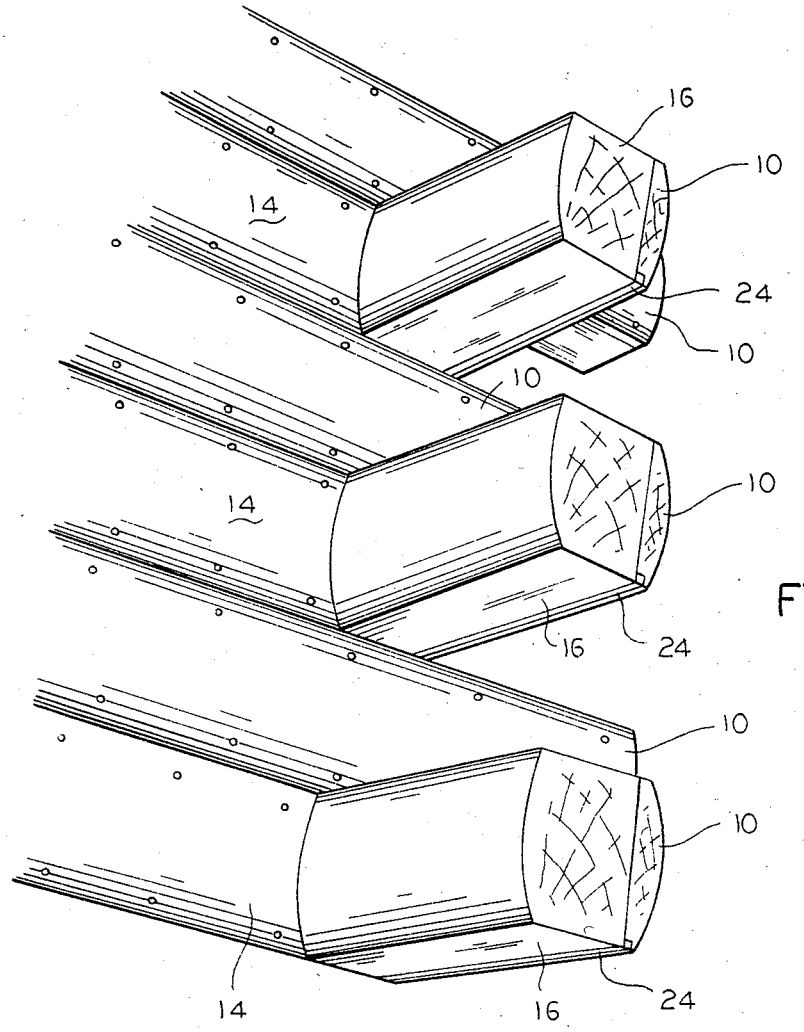
FIG. 1 is an isometric view of a portion of a cornering system embodying the instant invention, from a low angle.
Figure 2:
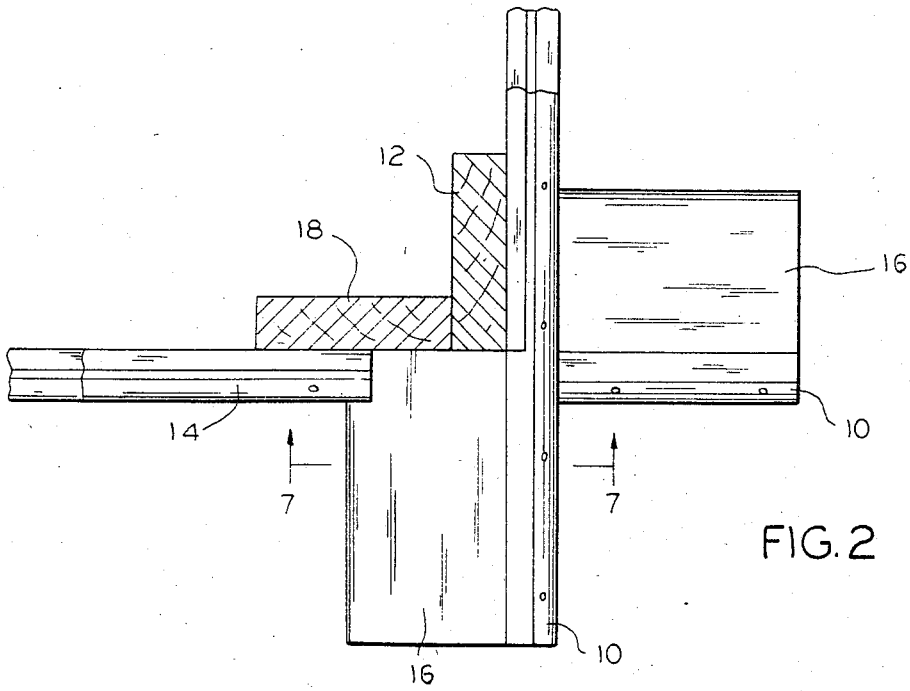
FIG. 2 is a top view of the invention shown in FIG. 1.
Figure 3:
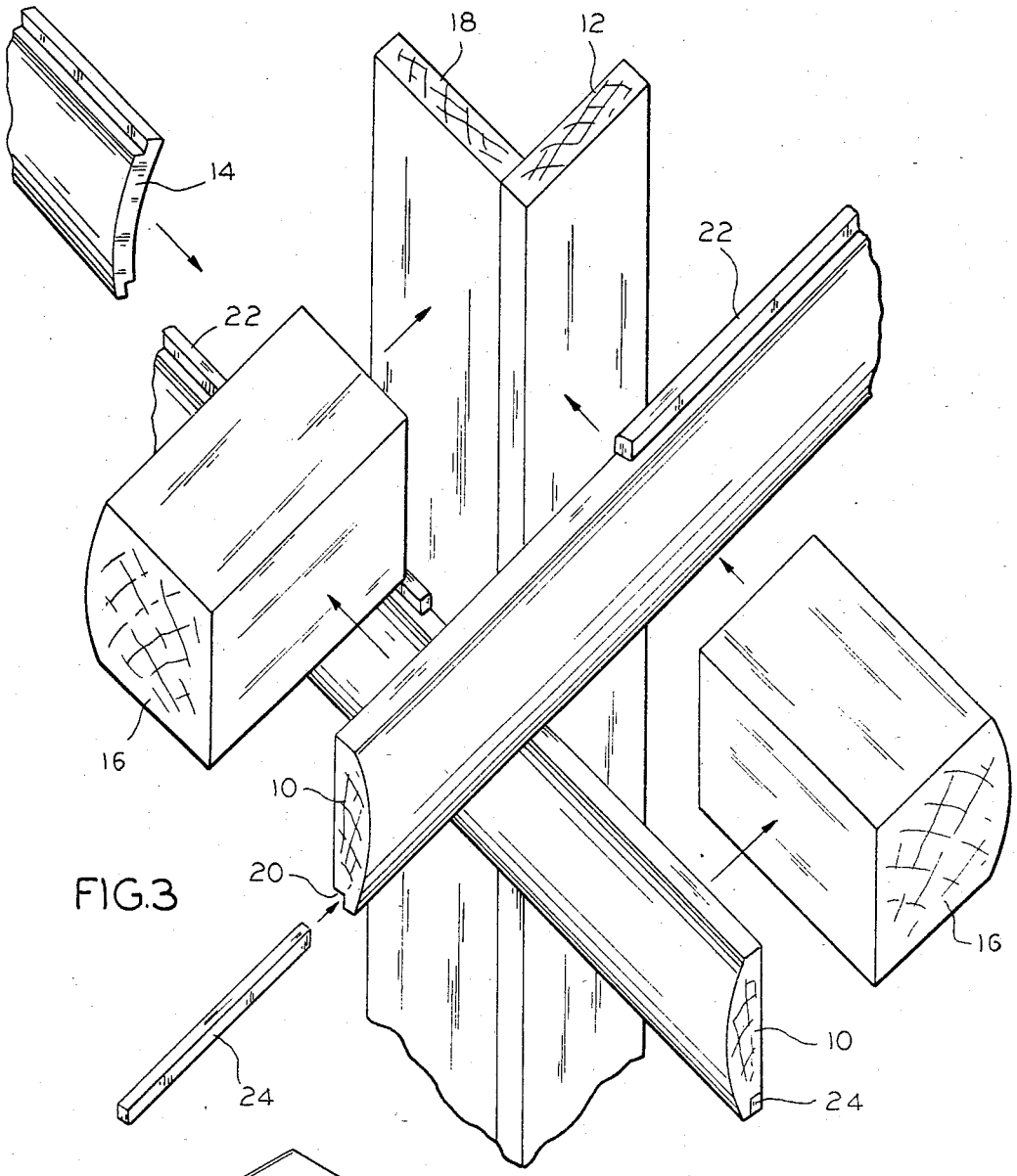
FIG. 3 is an exploded isometric view of the invention.
Figure 4:
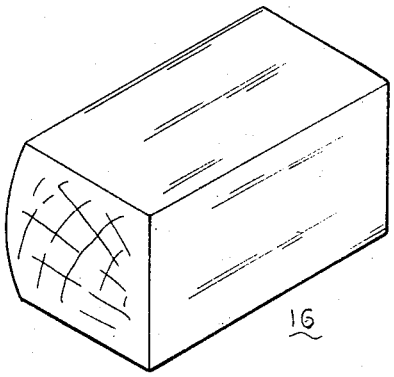
FIG. 4 is an isometric view of the log block employed in the invention.
Figure 7:
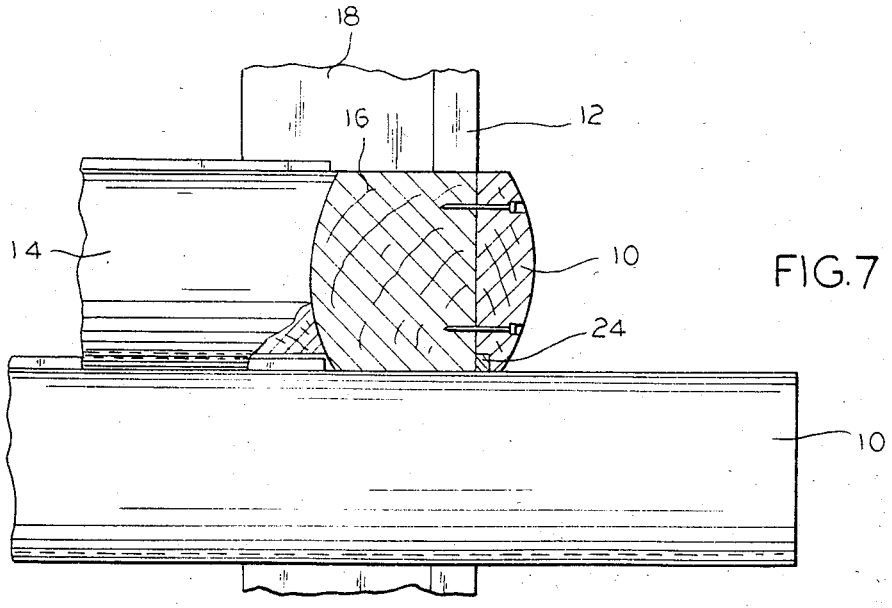
FIG. 7 is a front view, partially in section, taken along line 7—7 of FIG. 2.

Referring to FIG. 1, this invention includes siding having a rounded outer surface, which is cut to different lengths as it is applied to the exterior of a building. Extended portions 10 of siding are cut off straight, at a point where they reach approximately two siding widths beyond the stud 12 on the corners of the building, shown in FIG. 2. On the intersecting wall, on the same layer of siding as extended siding portion 10, shortened portions 14 of siding are cut off short of the corner, the cut being concave, as shown in FIGS. 3 and 7. This is done to allow room for insertion of log block 16. The height of block 16 is the same as the width of the rounded siding. The thickness of the block is about the same as the height, in order to give an approximately rounded appearance to the end section, as shown in FIG. 7. The length of block 16 is the same as the distance that the extended piece 10 reaches beyond corner stud 12.

This log block 16 is affixed in place by nails and/or glue, preferably both for best strength and weather seal. One end of block 16 is butted up against corner studs 12 and 18. The one rounded side of block 16 is fitted into the concave cut of shortened siding portion 14. Here again glue is applied, as a weather seal, to the area where the two meet. The side opposite the rounded side is nailed and/or glued to extended siding portion 10.

The type of siding used can be either tongue-in-groove or ship lap, but the preferred embodiment employs ship lap, and this is the only type shown in the drawings, since it is much easier to handle any warpage problems which develop when using the latter rather than the former. Each portion of tongue-in-groove siding has a tongue at its upper edge and a groove at its lower edge.

Figure 5:
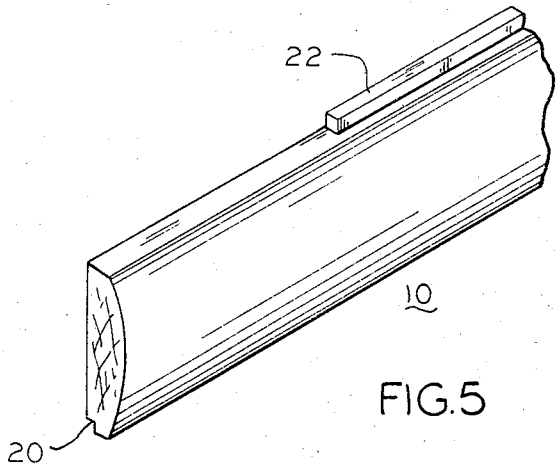
FIG. 5 is an isometric view of an end portion of rounded siding employed in the invention.
Figure 6:
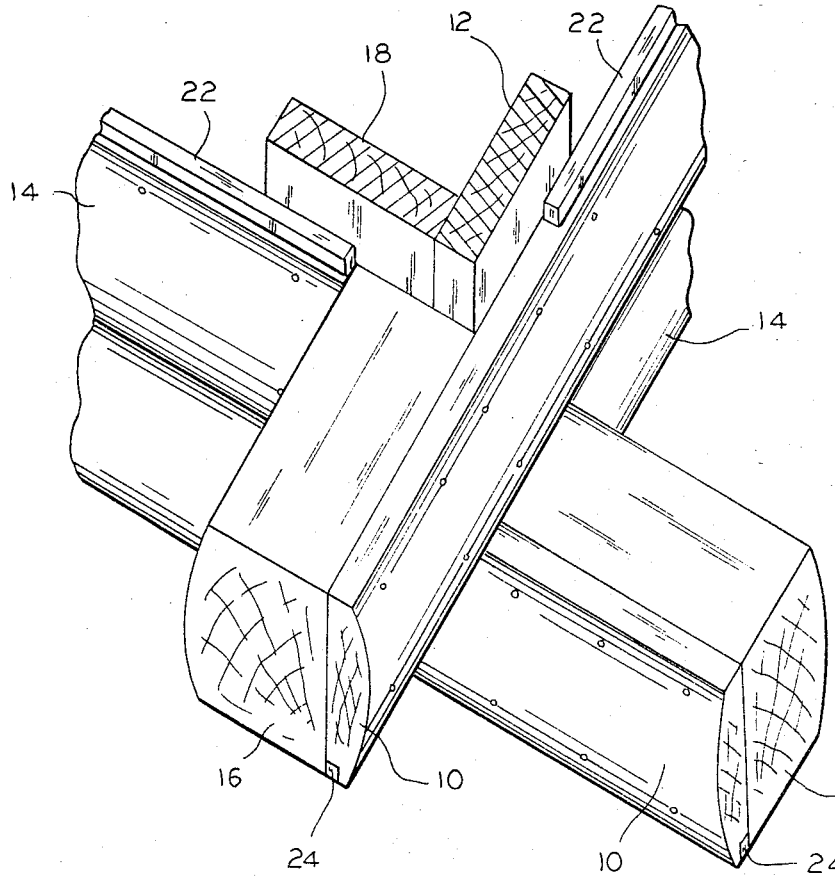
FIG. 6 is an isometric view of the invention from a high angle.

Ship lap siding still does have a notch 20 at the bottom edge and a ridge 22, FIG. 5, at the upper edge, however. Hence when block 16 is attached against extended siding portion 10, a groove is created along the bottom of the "log" thus formed. To prevent the entrance of pests by this route and to generally provide a more finished appearance, a filler member 24 is inserted in this groove, again by nails and/or glue. In addition, ridge 22 at the upper edge is removed back to a point where it does not interfere with block 16 on the next higher layer.

The final result is a building having a realistic log appearance, using less wood and thus less money than conventional full log buildings. The building is better sealed against the elements, and the wall insulation can have up to four times the "R" factor, again when compared to full log buildings. In addition, the "log" ends, including extended siding portion 10, block 16 and filler member 24, are sturdy enough to be used as a ladder to climb up the corner of the building if necessary. Finally, this log cornering system can be added to any sided building when a new layer of siding is added, making the conversion of existing buildings easier.

While the apparatus hereinbefore described is effectively adapted to fulfill the aforesaid objects, it is to be understood that the invention is not intended to be confined to the particular preferred embodiments of cornering systems for log buildings herein set forth, inasmuch as they are susceptible of various modifications without departing from the scope of the appended claims.

What is claimed is:

1. An improved cornering system for log buildings comprising:

conventionally assembled corner studs;

an extended siding portion affixed to said corner studs and extending beyond the corner, having a rounded outer surface;

a shortened siding portion affixed to said corner studs in the same layer of siding as said extended portion but on the intersecting wall, said shortened portion having a rounded outer surface and being cut off short of the corner in a concave shape so as to leave a gap between itself and said extended portion;

a log block having a rounded outer surface inserted into the gap between said shortened portion and said extended portion such that its rounded outer surface fits into the concave cut formed in said shortened portion; and said log block further being secured to said corner studs and said extended portion such that a projection similar in appearance to a log end protrudes beyond the corner.

2. A cornering system as recited in claim 1 wherein said siding is of the tongue-in-groove type, and further comprising means for filling in the groove at the lower edge of each such extended siding portion where it extends beyond the corner, so as to give a smooth appearance around the circumference of the log projection.

* * * * *